United States Patent [19]

Alm et al.

[11] Patent Number: 4,920,860

[45] Date of Patent: May 1, 1990

[54] DEVICE FOR BIASING A CYLINDER DRUM OF A VARIABLE-DISPLACEMENT AXIAL PISTON MACHINE AGAINST AN ASSOCIATED SLIDE VALVE MEMBER

[75] Inventors: Filip Alm, Surte; Sven Gulbrandsen, Trollhättan; Bo Larsson, Vändersborg; Sune Ekdahl, Trollhättan, all of Sweden

[73] Assignee: Volvo Hydraulik AB, Trollhattan, Sweden

[21] Appl. No.: 244,181

[22] Filed: Sep. 14, 1988

[30] Foreign Application Priority Data

Sep. 18, 1987 [SE] Sweden ..... 8703620

[51] Int. Cl.[5] ..... F04B 1/20

[52] U.S. Cl. ..... 91/504

[58] Field of Search ..... 91/499, 504, 505, 506, 91/507; 417/222

[56] References Cited

U.S. PATENT DOCUMENTS

| | | | |
|---|---|---|---|
| 3,289,604 | 12/1966 | Wahlmark | 91/507 X |
| 3,331,288 | 7/1967 | Kolthoff, Jr. | 91/507 |

FOREIGN PATENT DOCUMENTS

| | | | |
|---|---|---|---|
| 457803 | 9/1929 | Fed. Rep. of Germany | 91/505 |
| 2643770 | 4/1977 | Fed. Rep. of Germany | 91/505 |
| 267265 | 3/1927 | United Kingdom | 91/505 |

OTHER PUBLICATIONS

A.P.C. Application of J. Mercier, Ser. No. 335,386, Published Jun. 1, 1943.

*Primary Examiner*—Leonard E. Smith

*Attorney, Agent, or Firm*—Pollock, Vande Sande and Priddy

[57] ABSTRACT

A device for biasing a cylinder drum in a variable-displacement axial piston machine against an associated slide valve member comprises a compression spring means, the axial piston machine having between the cylinder drum and the drive disk a synchronizing shaft which at each of its ends has a universal joint of the so-called tripoid type for angularly rigid but pivotable connection with the drum and disk, respectively, the synchronizing shaft furthermore being supported at each end approximately axially from the cylinder drum and drive disk, respectively, by a link pin. In order to provide a biasing device which requires less space adjacent the cylinder drum and thus allows a more compact design thereof, the compression spring means is mounted between a link pin bearing cup axially movably arranged in the center of the drive disk, and an abutment means, which is co-axial with and adjustably secured to said disk and the machine shaft associated therewith, such that the biasing force is applied to the drum from said abutment means under the intermediation of the synchronizing shaft.

3 Claims, 1 Drawing Sheet

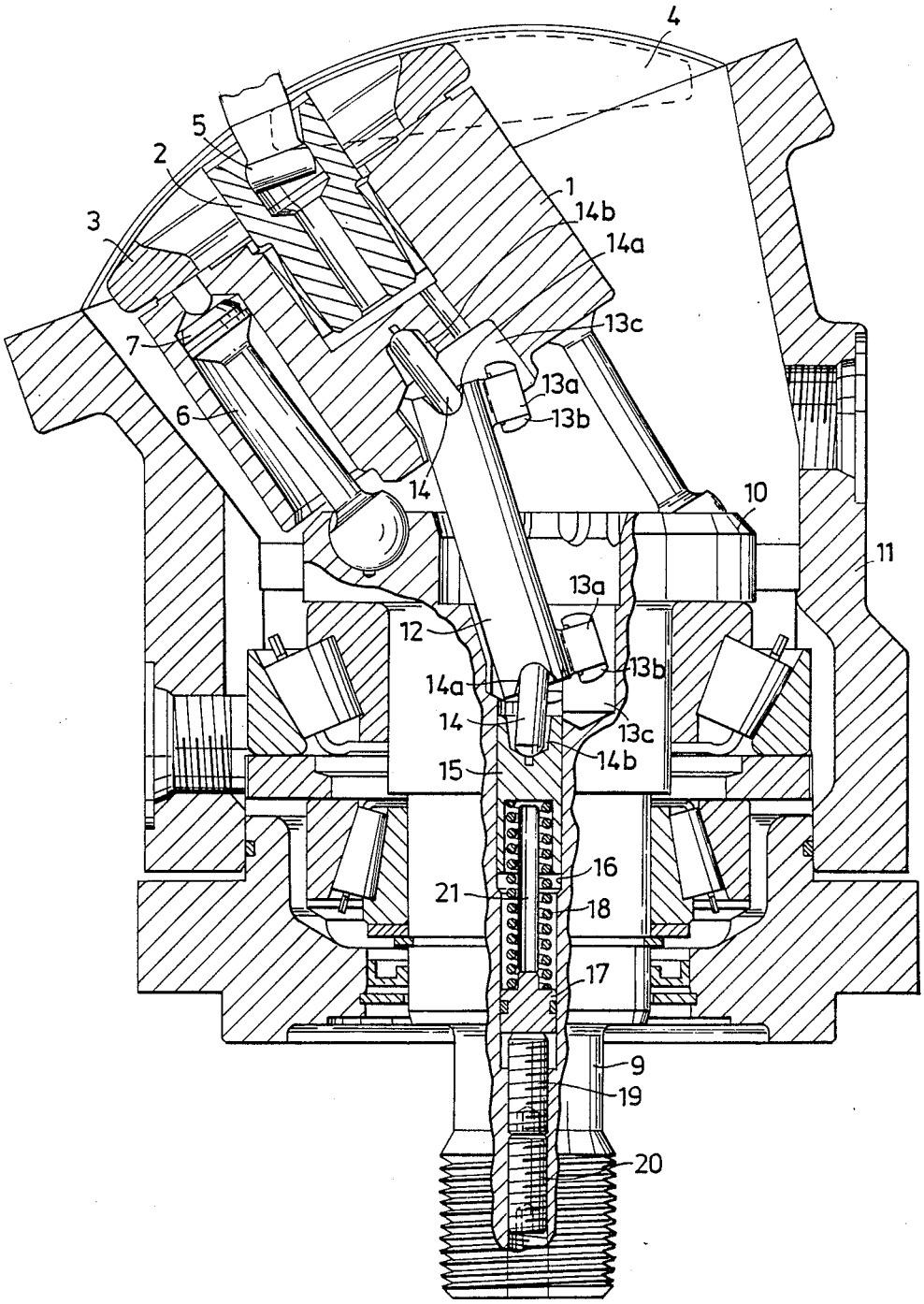
4
5
2
3
1
14b
14a
13c
7
13a
13b
6
14
10
11
13a
12
13b
14a
14
13c
14b
15
16
21
18
17
9
19
20

DEVICE FOR BIASING A CYLINDER DRUM OF A VARIABLE-DISPLACEMENT AXIAL PISTON MACHINE AGAINST AN ASSOCIATED SLIDE VALVE MEMBER

The present invention refers to a device for biasing a cylinder drum of a variable-displacement axial piston machine against an associated slide valve member and comprising a spring means, the axial piston machine having between the cylinder drum and a drive disk a synchronizing shaft for mutual synchronous rotation of said drum and disk, which shaft at each end has a universal joint of so-called tripoid type for angularly rigid but pivotable connection with the drum and the drive disk, respectively, the synchronizing shaft furthermore being supported at each end approximately axially from the drum and the drive disk, respectively, by a link pin.

In axial piston machines, it is essential that the end surface of the cylinder drum is kept biased or pressed against a slide valve surface. For obtaining this, a plurality of different proposals of basically two types have been made during the years, i.e. one type in which the biasing force is obtained by a slotted resilient ring or similar measures acting on the outer peripheral surface of the cylinder drum (see e.g. the Swedish Patent Spfn. 320 269 or its U.S. counterpart), or another type in which the biasing force is applied centrally on the drum. As an example of a device of the latter kind in which the biasing force is centrally applied, see Wahlmark U.S. Pat. No. 3,289,604. The central rotary bearing of the drum by means of a thrust-type roller bearing requires radial space, however, and it has also other drawbacks. The Applicant's prior Swedish Patent Spfn. 74 06378-5 describes a proposal for biasing a cylinder drum, in which the biasing force is applied to the end surface of the drum opposite to the valve surface thereof by means of a peripheral bearing ring, upon which acts the spring means. Formerly, this last-mentioned structure has been considered to be the most space-saving one obtainable, but during the further development of axial piston machines it has turned out in such machines of variable-displacement type that this biasing device still requires certain valuable space. In connection with ever-increasing hydraulic pressures this bearing ring has also been found to incur noticeable friction losses.

There is thus a demand for providing a still more compact structural design of the cylinder drum biasing device, and at the same time such a device has to be free of losses. The main object of the present invention therefore is to suggest a device which makes this possible, and the invention is substantially distinguished in that the spring means is mounted between a link pin bearing cup, axially movably arranged in the center of the drive disk, and an abutment means which is coaxial with and adjustably secured to said disk and the associated machine shaft, such that the biasing force is applied to the drum from said abutment means under the intermediation of said synchronizing shaft.

Since in a variable-displacement axial piston machine having a synchronizing shaft of the aforementioned kind there occurs a long series of tolerances of the parts built together, the biasing pressure essentially determining for the operation of the machine cannot be designed into the machine but has to be obtained by adjustments. The major advantage of the design now suggested according to the invention is that this adjustment can be carried out in a very simple and hitherto impossible manner, namely from the outside of the machine through a central bore in the machine shaft, where thus access to the adjustable abutment means can be had. Since the biasing force is transferred only through the synchronizing shaft with its pair of link pins, the most compact design is obtained, since no space-requiring spring arrangements are necessary, either internally or externally of the cylinder drum or in the synchronizing shaft.

By way of example, the invention will be further described with reference to the accompanying drawing, which illustrates a longitudinal section through a variable-displacement axial piston machine provided with the biasing device according to the invention.

In the drawing it is thus illustrated a variable-displacement axial piston machine with a cylinder drum 1 which centrally is rotatably journalled on a pin 2 carried by a valve segment 3. Said segment 3 comprises inlet and outlet conduits for the cylinder drum 1, and for varying the displacement of the machine the segment is reciprocatory moveable in a groove 4 in a machine housing 11 in the plane of the drawing by means of an adjustment device, of which only an associated actuation arm 5 is illustrated.

As conventional, in the cylinder drum 1 is arranged a plurality of circumferentially equally spaced cylinder bores 6, such as nine such bores, in each of which a piston 7 runs. Through a piston rod each piston is connected with a part-spherical piston rod end, which is journalled universally pivotable in a corresponding recess in a drive disk 10. In its turn, said disk 10 is rotatably mounted in the surrounding machine casing 11 and rigidly secured to or integral with the machine shaft 9.

For securing a permanently synchronous rotational movement of the cylinder drum 1 and the drive disk 10 independent of their mutual angular position for various selected displacements of the machine, they are connected to each other in a conventional way by means of a synchronizing shaft 12. At each end said shaft 12 carries a universal joint 13, preferably of so-called tripoid type, i.e. having three bearing studs **13*a* extending at right angles from the shaft 12 and equally spaced circumferentially, each stud furthermore carrying a rotatable bearing roller 13*b*. Said rollers are housed in mating axial bearing grooves 13*c* formed in the wall of a central bore in the end surface of the cylinder drum, which faces the shaft 12, and of the drive disk 10, respectively. For allowing great adjustment angles of the cylinder drum 1 relative to the drive disk 10 to either side of the central neutral position, namely of an order of magnitude of about 42° or even more, it is well known that both ends of the synchronizing shaft 12 must be free to orbit in a small circular path. For controlling this orbital motion, a link pin 14 is inserted between a bearing cup 14*a* at the end of the shaft 12 and a central bearing cup 14*b* in the cylinder drum 1 and the drive disk 10, respectively, so as to support the synchronizing shaft 12 approximately axially therefrom. Preferably, both link pins 14 have a cylindrical shape with spherically rounded ends to rest in the bearing cups 14*a*, 14*b***.

According to the present invention the bearing cup **14*b* is now formed in a support means 15, which is mounted in the drive disk 10 coaxially therewith and which is axially movable in a central bore 16 extending through the drive disk and the machine shaft 9 rigidly secured thereto. In said bore 16 is inserted an abutment means 17, and between said means 17 and the support means 15 is mounted a compression spring 18. The axial position of the abutment means 17 in the bore 16 and hence the value of the force applied by the compression spring 18 to the cylinder drum 1 under the intermediation of the synchronizing shaft 12 is defined by a set screw 19, threaded into a threaded portion of the bore 16. When needed, said set screw may be lockable by means of a locking screw 20 axially outside the same. It is to be particularly remarked that said screws 20 and 19 thus are accessible from the free end of the machine shaft 9, which is located outside the machine housing 11. In order to restrict the possibilities of the cylinder drum 1 to raise axially from its engagement with the valve segment 3, it is furthermore preferred that the spring travel between the support means 15 and the abutment means 17 be restricted by a spacing member 21. In the embodiment illustrated in the drawing, in which the the helically-coiled compression spring 18 is long and thin, it is thus suitable that said spacing member 21 has the form of a rod, located inside the spring and having a length which provides for an axial play or clearance between the abutment means 17 and the support means 15** of the order of 0.1 mm.

In the device according to the invention it has thus turned out that the necessary biasing force on the cylinder drum 1 does not need to be applied directly on said drum but the synchronizing shaft 12 might advantageously be utilized for the transmission of said biasing force in spite of the angular position between the shaft 12 and the cylinder drum 1 and the drive disk 10, respectively. In this way it primarily achieved that the space requirements for the cylinder drum 1 and its biasing mechanism are reduced and moreover, an adjustment of the biasing force on the cylinder drum 1 can be carried out very easily from the outside of the machine without any need for dismantling the same in any way.

Although in the embodiment described above, the support means 15 is made axially movable separately in the bore 16 in the drive disk 10, said support means 15 might also be rigidly secured to or integral with a cup-shaped bearing means (not illustrated), in which are formed the bearing grooves 13*c* and which is non-rotatably but slightly axially movably connected with the drive disk 10. Also other modifications of the above-described embodiment of the inventive subject matter can be made within the scope of the accompanying claims, as will be obvious to the artisan.

We claim:

1. A biasing device for biasing a cylinder drum in a variable-displacement axial piston machine against an associated slide valve surface, said axial piston machine having a rotatable cylinder drum disposed in contact with a valve segment adjacent one end of said machine, a rotatable drive disk located between said cylinder drum and the other end of said machine, a drive shaft extending from said drive disk in coaxial relation thereto at said other end of said machine, an elongated bore extending through said drive disk and drive shaft in coaxial relation thereto, the axes of rotation of said cylinder drum and drive disk being at an angle to one another, a synchronizing shaft located between said cylinder drum and said drive disk for synchronizing the rotation of said drum and disk, each end of said synchronizing shaft having a universal joint of the tripoid type for angularly rigid but pivotable connection with said cylinder drum and said drive disk respectively, said synchronizing shaft being supported at its opposite ends by a pair of link pins which are disposed at angles to one another, at angles to said synchronizing shaft, and at angles to the axes of rotation of said cylinder drum and drive disk, one of said link pins extending between the end of said synchronizing shaft closest to said cylinder drum and a first bearing cup in said cylinder drum, and the other of said link pins extending between the other end of said synchronizing shaft and a second bearing cup that is provided in a support member which is axially movable in said bore, spring means located in said bore between said support member and an abutment means that is axially movable in said bore in spaced relation to said support member, and adjustment means in said drive shaft for varying the position of said abutment means in said bore to vary the force that is exerted by said spring means on said support member, the only biasing force other than fluid pressure forces exerted on said cylinder drum to keep said cylinder drum in contact with said valve segment being an adjustable biasing force that is applied to said cylinder drum from said spring means and abutment means via said support member, said synchronizing shaft and said link pins.

2. The biasing device of claim 1 wherein the extent of resilient movement of said spring means between said abutment means and said support member is limited by spacing means.

3. The biasing device of claim 2 wherein said spring means is an elongated helically coiled compression spring, said spacing means comprising an elongated rod disposed in coaxial relation to said bore within the coils of said compression spring.

* * * * *